US008523031B2

(12) United States Patent
Hedrick

(10) Patent No.: US 8,523,031 B2
(45) Date of Patent: Sep. 3, 2013

(54) LANYARD APPARATUS FOR CARRYING DEVICES

(76) Inventor: Shane Hedrick, Raleigh, NC (US)

( * ) Notice: Subject to any disclaimer, the term of this patent is extended or adjusted under 35 U.S.C. 154(b) by 32 days.

(21) Appl. No.: 13/316,074

(22) Filed: Dec. 9, 2011

(65) Prior Publication Data

US 2013/0146635 A1 Jun. 13, 2013

(51) Int. Cl.
*A45F 3/14* (2006.01)

(52) U.S. Cl.
USPC ..... 224/257; 224/600; 224/930; 224/901

(58) Field of Classification Search
USPC ..... 224/257, 600, 929–930, 901
See application file for complete search history.

(56) References Cited

U.S. PATENT DOCUMENTS

| | | | | |
|---|---|---|---|---|
| 2,619,705 | A * | 12/1952 | Boutwell | 428/219 |
| D370,776 | S * | 6/1996 | Frey | D3/218 |
| 5,938,137 | A | 8/1999 | Poulson | |
| 6,014,585 | A * | 1/2000 | Stoddard | 607/2 |
| 6,519,796 | B2 * | 2/2003 | Sloot | 5/636 |
| D512,560 | S * | 12/2005 | Williford | D3/218 |
| 7,643,646 | B2 | 1/2010 | Fielding, Jr. | |
| 7,650,007 | B2 | 1/2010 | Iuliis et al. | |
| 7,661,567 | B2 | 2/2010 | Myers | |
| 7,661,620 | B2 | 2/2010 | Fields | |
| 7,682,661 | B2 * | 3/2010 | Lauer | 427/259 |
| D671,933 | S * | 12/2012 | Rodgers | D14/250 |
| 2005/0022924 | A1 * | 2/2005 | Blackburn | 156/230 |
| 2006/0040081 | A1 * | 2/2006 | Hodsdon et al. | 428/40.1 |
| 2006/0113345 | A1 * | 6/2006 | Zoullas et al. | 224/600 |
| 2006/0272890 | A1 | 12/2006 | Harmon et al. | |
| 2006/0276238 | A1 | 12/2006 | Shepard-Vagedes | |
| 2007/0021073 | A1 | 1/2007 | Gratton | |
| 2007/0181620 | A1 * | 8/2007 | Carver, III | 224/217 |
| 2008/0003392 | A1 * | 1/2008 | Maule et al. | 428/40.1 |
| 2008/0199695 | A1 * | 8/2008 | Patrick et al. | 428/364 |
| 2009/0013719 | A1 | 1/2009 | Loving et al. | |
| 2010/0171021 | A1 | 7/2010 | Smith | |
| 2010/0270189 | A1 * | 10/2010 | Pedersen et al. | 206/320 |
| 2011/0002094 | A1 | 1/2011 | Blouin | |
| 2011/0266316 | A1 * | 11/2011 | Ghalib et al. | 224/217 |

FOREIGN PATENT DOCUMENTS

WO WO 00/72723 A1 12/2000

* cited by examiner

*Primary Examiner* — Justin Larson
*Assistant Examiner* — Scott McNurlen
(74) *Attorney, Agent, or Firm* — Myers Bigel Sibley & Sajovec, P.A.

(57) ABSTRACT

An apparatus for carrying hand held electronic and other types of devices includes a flexible substrate and a lanyard secured to the substrate. The substrate has opposite first and second surfaces and opposite first and second end portions. A layer of adhesive material is applied to at least a portion of the substrate first surface, and a protective layer of material is releasably secured to the adhesive material. When the protective layer is removed, the adhesive material is exposed such that the substrate can be secured to a device via the adhesive material. The adhesive material is intended to securely attach the substrate to the device and such that removal therefrom is difficult. The lanyard allows for the substrate and an attached device to be suspended around the neck of a user.

28 Claims, 6 Drawing Sheets

LANYARD APPARATUS FOR CARRYING DEVICES

FIELD OF THE INVENTION

The present invention relates generally to hand held electronic devices and, more particularly, to apparatus for carrying hand held electronic devices.

BACKGROUND

Hand held personal communication devices, such as cell phones, have become ubiquitous. Typically, these devices are carried in a person's pocket or in a bag such as a pocket book. As such, these devices may be readily separable from a person and may be subject to being stolen or damaged, particularly if dropped. These devices typically have display screens that are quite easily susceptible to damage when dropped. In addition, theses devices typically contain large amounts of information, as well as access to data banks of additional information. As such, loss or destruction of a personal communication device can be expensive as well as a substantial inconvenience to an owner.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, an apparatus for carrying hand held electronic devices, such as cell phones, includes a flexible substrate and a lanyard secured to the substrate. The substrate has opposite first and second surfaces and opposite first and second end portions. A layer of adhesive material is applied to at least a portion of the substrate first surface, and a protective layer of material is releasably secured to the adhesive material. When the protective layer is removed, the adhesive material is exposed such that the substrate can be secured to a housing of a hand held electronic device via the adhesive material. The adhesive material is intended to securely attach the substrate to the housing of a device and such that removal therefrom is difficult. For example, in some embodiments of the present invention, the layer of adhesive material is capable of withstanding 1,000 grams of shear at 72° F. in accordance with ASTM D3654. The lanyard allows for the substrate and an attached electronic device to be suspended around the neck of a user.

In some embodiments of the present invention, the substrate is a strong, woven fabric, such as rip-stop nylon, rip-stop polyester, or silk, and has a thickness of less than about 0.015 inches. The substrate may have various shapes and configurations including, but not limited to, a polygonal shape, a round shape, an oval shape, a rectangular shape, and an hourglass shape. Moreover, the substrate may be easily cut by an end user to have any shape and/or configuration desired. In addition, the substrate may have apertures, cut-outs, and other configurations to accommodate a camera lens, speaker, or other feature in the housing of an electronic device. For example, the substrate may include an aperture formed therein through which a camera lens in the housing is exposed when the substrate is secured to the housing.

In some embodiments of the present invention, the lanyard is secured to the substrate first end portion via an attachment loop extending therefrom. The lanyard may be secured directly to the attachment loop or may be secured to the attachment loop via one or more couplers. The attachment loop may be a strap of flexible material sewn to the substrate, for example via a heat-resistant thread (e.g., aramid or similar fiber thread). In some embodiments, the strap of flexible material and the substrate are formed of the same or similar fabric.

In some embodiments of the present invention, the substrate second surface has a tactile configuration that facilitates gripping by a user's hand. For example, the tactile configuration may include an array of raised portions extending outwardly from the substrate second surface.

In some embodiments of the present invention, the substrate second surface comprises indicia. The substrate second surface may also have a blank space area thereon for receiving indicia, such as the name of the owner of an electronic device.

In some embodiments of the present invention, a patch is adhesively secured to the substrate second surface. The patch may include indicia thereon.

In some embodiments of the present invention, the protective layer of material may include a pattern thereon for facilitating cutting an aperture in the flexible substrate by a user. For example, a pattern for an aperture may be located on the protective layer of material at a location of a camera lens, etc.

According to other embodiments of the present invention, a protective case for a hand held electronic device includes a substrate and a lanyard secured to the substrate. The protective case includes a base surface upon which a back of a housing of an electronic device will be placed against. The substrate is adhesively secured to the base surface, and the lanyard is secured to the substrate and allows the protective case and an attached electronic device to be suspended around the neck of a user. The adhesive material utilized is intended to securely attach the substrate to the base surface such that removal therefrom is difficult. For example, in some embodiments of the present invention, the layer of adhesive material is capable of withstanding 1,000 grams of shear at 72° F. in accordance with ASTM D3654.

The substrate is a strong, woven fabric, such as rip-stop nylon, rip-stop polyester, or silk, and has a thickness of less than about 0.015 inches. The substrate may have various shapes and configurations including, but not limited to, a polygonal shape, a round shape, an oval shape, a rectangular shape, and an hourglass shape. Moreover, the substrate may be easily cut by an end user to have any shape and/or configuration desired. In addition, the substrate may have apertures, cut-outs, and other configurations to accommodate openings and various other features of the protective case.

In some embodiments of the present invention, the lanyard is secured to an end portion of the substrate via an attachment loop extending therefrom. The lanyard may be secured directly to the attachment loop or may be secured to the attachment loop via one or more couplers. The attachment loop may be a strap of flexible material sewn to the substrate, for example via a heat-resistant aramid thread or similar fiber thread. In some embodiments, the strap of flexible material and the substrate are formed of the same or similar fabric.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1:
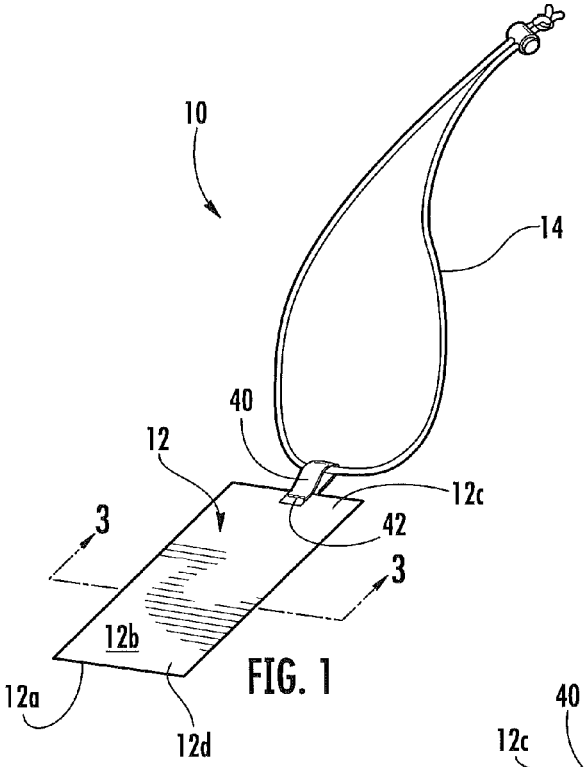
FIG. 1 is a perspective view of an apparatus for carrying hand held electronic devices, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Referring now to FIG. 1, an apparatus 10 for carrying hand held devices is illustrated. Exemplary devices that may be carried by apparatus 10 include, but are not limited to, electronic devices such as cell phones, pagers, personal digital assistants (PDAs), tablet computers, electronic book devices, etc. in addition, various non electronic devices may be carried by apparatus 10 including, but not limited to, medicine containers, cigarette cases, remote controls for electronic devices, eyeglass cases, bottle of hand sanitizer, etc.

Figure 2:
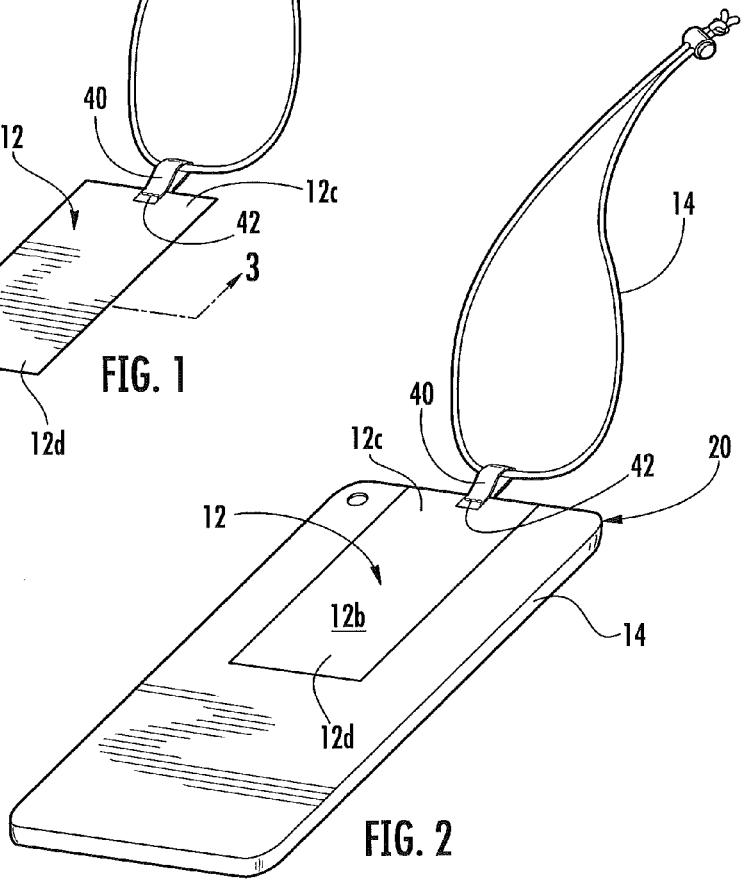
FIG. 2 is a perspective view of an electronic device with the apparatus of FIG. 1 secured thereto, according to some embodiments of the present invention.
Figure 3:
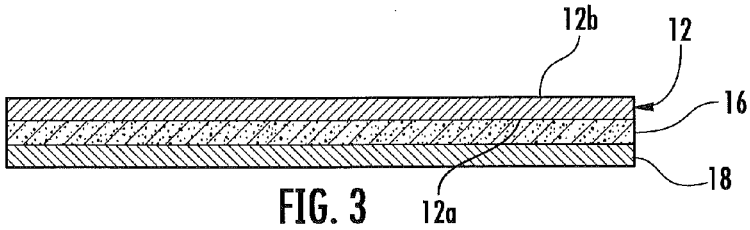
FIG. 3 is a cross sectional view of the substrate of the apparatus of FIG. 1 taken along lines 3-3.

The illustrated apparatus 10 includes a flexible substrate 12 and a lanyard 14 secured to the substrate 12. The lanyard 14 allows for the substrate 12 and an attached electronic device (20, FIG. 2) to be suspended around the neck of a user. The substrate 12 has opposite first and second surfaces 12*a*, 12*b* and opposite first and second end portions 12*c*, 12*d*. A layer of adhesive material 16 (FIG. 3) is applied to at least a portion of the substrate first surface 12*a*, and a protective layer of material 18 (FIG. 3), such as kraft paper, etc., is releasably secured to the adhesive material 16. The protective layer of material 18 is configured to be removed from the adhesive material 16 by a user, for example, via one or more tabs, or via a slit formed in the protective layer of material 18. When the protective layer of material 18 is removed, the adhesive material is exposed such that the substrate 12 can be secured to a housing H of a hand held electronic device 20 via the adhesive material 16, as illustrated in FIG. 2.

The adhesive material 16 is intended to securely attach the substrate 12 to the housing H of an electronic or other device 20 and such that removal of the substrate 12 from the device is difficult. For example, in some embodiments of the present invention, the layer of adhesive material 16 is capable of withstanding 1,000 grams of shear at 72° F. in accordance with ASTM D3654.

The substrate 12 may be a woven fabric formed from a variety of fibers having sufficient tensile strength. Exemplary fibers include, but are not limited to, nylon, polyester, silk, wool, hemp and cotton. In one embodiment, the substrate 12 is formed from parachute material. Exemplary parachute material includes, but is not limited to, rip-stop nylon, rip-stop polyester, and silk. Rip-stop nylon is a light weight, water repellent nylon fabric with inter-woven rip-stop reinforcement threads in a crosshatch pattern, so the material resists ripping or tearing. Similarly, rip-stop polyester is a light weight, water repellent polyester fabric with inter-woven rip-stop reinforcement threads in a crosshatch pattern, so the material resists ripping or tearing. However, various types of fabrics may be utilized. Embodiments of the present invention are not limited to any particular type of material. Moreover, the substrate 12 is not limited to woven fabrics. In some embodiments of the present invention a nonwoven fabric may be utilized. Furthermore, the substrate 12 is not required to be a fabric. The substrate 12 may be any type of material that can be adhesively secured to the housing of an electronic device and that has sufficient strength to remain securely adhered to the housing of an electronic device. In addition, the substrate 12 is not required to be a flexible material.

According to some embodiments of the present invention, the substrate 12 is a thin material, for example, having a thickness of less than about 0.015 inches, for example: 0.014 inch, 0.013 inch, 0.012 inch, 0.011 inch, 0.010 inch, 0.009 inch, 0.008 inch, 0.007 inch, 0.006 inch, 0.005 inch, 0.004 inch, 0.003 inch, 0.002 inch, 0.001 inch, 0.0005 inch, 0.00025 inch, etc. However, embodiments of the present invention are not limited to the substrate 12 only having a thickness of less than about 0.015 inches. Fabrics and materials having other thicknesses can be utilized, as well. For example, fabrics and materials having a thickness of 0.015 inches, as well as thicknesses greater than 0.015 inches may be utilized (e.g., 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, 0.10 inch, 0.15 inch, 0.20 inch, 0.25 inch, 0.30 inch, etc.).

The substrate 12 may have a waterproof or water-resistant coating on the outer or second surface 12*b*. Exemplary coatings include, but are not limited to, urethane coatings.

Figure 4:
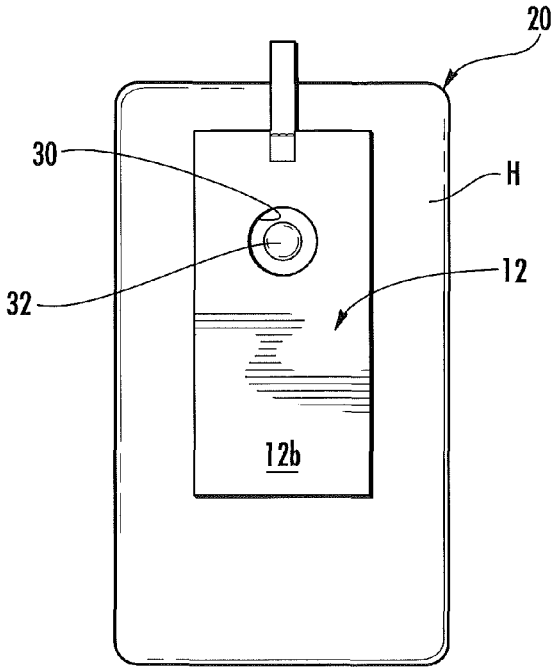
FIG. 4 is a plan view of an apparatus for carrying hand held electronic devices, according to some embodiments of the present invention, and wherein an aperture is formed in the substrate to expose a camera lens in the housing of an electronic device.
Figures 5A, 5B, 5C, 5D:
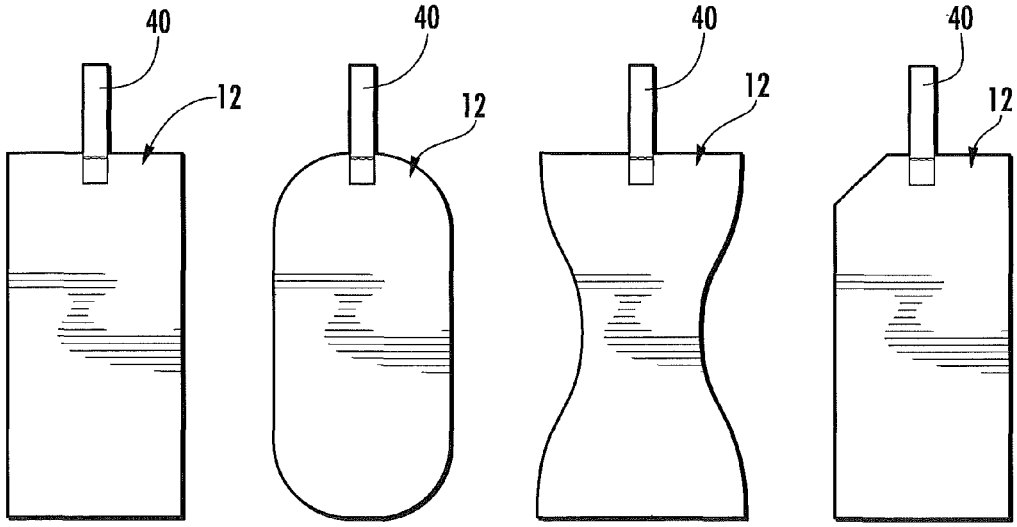
FIGS. 5A-5D are plan views illustrating various shapes of a substrate for an apparatus for carrying hand held electronic devices, according to some embodiments of the present invention.

Many hand held communication devices have cameras, and a camera lens is often positioned on the rear housing thereof. As illustrated in FIG. 4, a camera lens 32 is positioned in a medial portion of the housing H of electronic device 20. The substrate 12 secured to the housing H has an aperture 30 formed therein through which the camera lens 32 is exposed. Some hand held communication devices with cameras include the camera lens in other locations, for example, in the upper left corner thereof. A substrate 12, according to some embodiments of the present invention can have a configuration to accommodate various locations of a camera lens, speaker, etc. For example, as illustrated in FIG. 5D, the upper left corner of the substrate 12 is cut away. The cut away corner allows for the substrate 12 to be secured to an electronic device such that the upper left corner of the housing of an electronic device containing a camera lens, speaker, etc., is not covered.

In addition, a substrate 12, according to embodiments of the present invention, may have various shapes and configurations as illustrated in FIGS. 5A-5D. For example, the substrate may have a rectangular shape (FIG. 5A), an oval shape (FIG. 5B), an hourglass shape (FIG. 5C). Although not illustrated, the substrate 12 can have virtually any polygonal shape. In addition, the substrate 12 can have various configurations to accommodate the shape and/or functionality of an electronic device. Moreover, a substrate 12, according to embodiments of the present invention, may be cut by a user to have any shape and/or configuration desired.

Returning to FIG. 1, the illustrated substrate 12 includes an attachment loop 40 extending from the substrate first end portion 12C, and the lanyard 14 is secured to the substrate first end portion 12*c* via the attachment loop 40. The attachment loop 40 is a strap of flexible material sewn to the substrate 12 via thread 42. Exemplary thread 42 may include, but is not limited to, thread formed from heat resistant aramatic polyamide (e.g., Kevlar® brand fiber from DuPont, Wilmington, Del.) or similar fibers. In some embodiments, the strap of flexible material and the substrate are formed of the same or similar fabric, such as, for example, rip-stop nylon, rip-stop polyester, silk, etc. However, the attachment loop 40 may be formed from a different material (e.g., grow grain ribbon material, etc.). In addition, the ends of the attachment loop 40 may be tucked under when stitched to the substrate 12.

In the illustrated embodiments, the lanyard 14 is secured directly to the attachment loop 40. However, in other embodiments of the present invention, the lanyard 14 may be secured to the attachment loop 40 via one or more couplers. Exemplary couplers that may be utilized include, but are not limited to clips, carabiners, key rings, etc. The lanyard 14 may be a cord, such as a braided cord, a strap, a rope, a string, etc. Embodiments of the present invention are not limited to any particular type of length of lanyard 14.

In addition, embodiments of the present invention do not require a lanyard. In some embodiments, a clip or other coupling device attached to the attachment loop 40 may be utilized to secure the substrate and a device adhesively attached thereto to a belt loop, pocket, purse, handbag, or other article or article of clothing.

Figure 8:
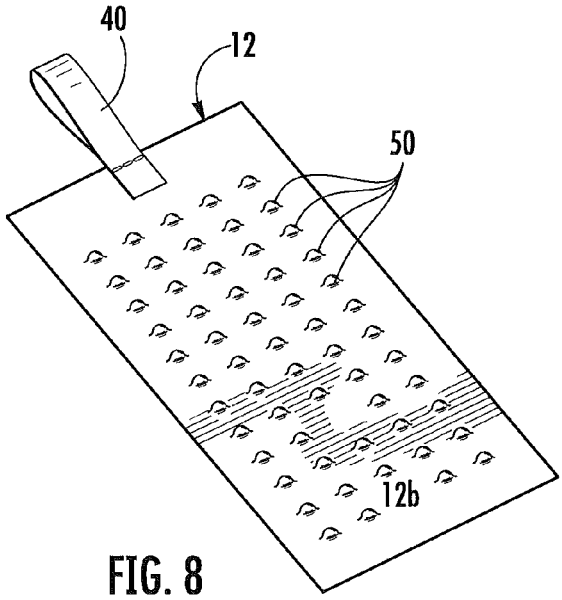
FIG. 8 is a perspective view of the substrate of the apparatus of FIG. 1 illustrating a tactile outer surface configuration, according to some embodiments of the present invention.

In some embodiments of the present invention, the substrate second surface 12*b* has a tactile configuration that facilitates gripping by a user's hand. For example, as illustrated in FIG. 8, the tactile configuration may include an array of raised portions 50 extending outwardly from the substrate second surface 12*b*. However, various ways known to those of skill in the art of the present invention may be utilized for providing a tactile feel to the substrate second surface 12*b* to facilitate gripping by a user. Embodiments of the present invention are not limited to an array of raised portions. Various ways of making the second surface 12*b* tactile are known and can be utilized in accordance with embodiments of the present invention.

Figure 9:
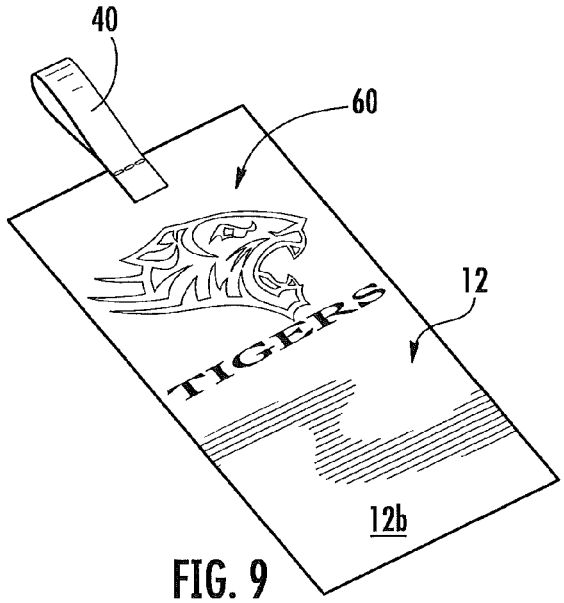
FIG. 9 is a perspective view of the substrate of the apparatus of FIG. 1 illustrating indicia on an outer surface thereof, according to some embodiments of the present invention.

Referring to FIG. 9, the substrate second surface may include various promotional and/or other indicia 60. The terms "indicia" and "promotional indicia" are intended to include all types of printed material including, but not limited to, text, lettering (i.e., alphabetical characters, alphanumeric characters), designs, characters, logos, images, graphics, symbols, etc. Moreover, indicia and promotional indicia may be utilized virtually anywhere on the substrate second surface 12*b*, as well as on the attachment loop 40. In some embodiments of the present invention, the substrate 12 can be woven in a pattern to provide a decorative effect or indicia. Moreover, the substrate 12 can be woven to provide the second surface 12*b* with a tactile configuration.

Figure 10:
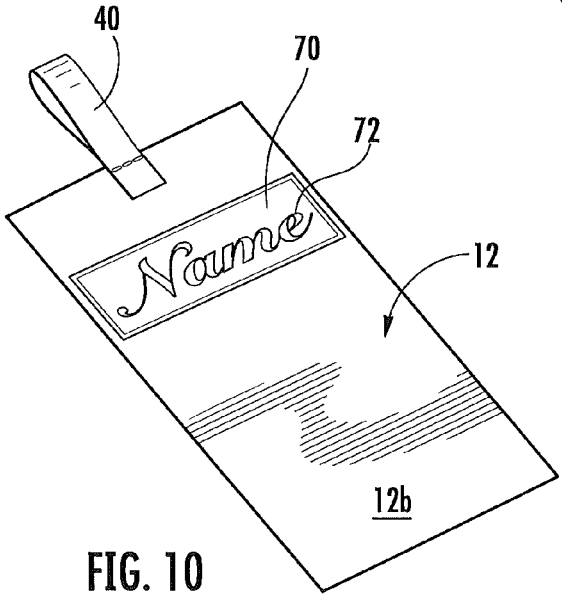
FIG. 10 is a perspective view of the substrate of the apparatus of FIG. 1 illustrating a space on an outer surface thereof for receiving indicia thereon, according to some embodiments of the present invention.

In addition, as illustrated in FIG. 10, the substrate second surface 12*b* may also have a blank space area 70 thereon for receiving indicia 72. For example, the owner of an electronic device 20 can write his/her name within the blank space area 70.

Figure 11A:
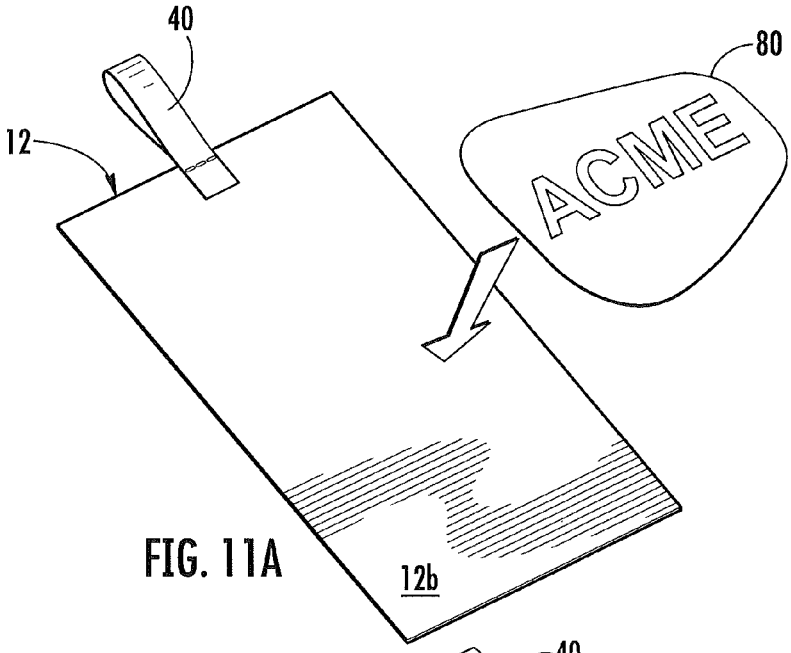
FIGS. 11A-11C are perspective views of the substrate of the apparatus of FIG. 1 illustrating a patch being secured to an outer surface thereof, according to some embodiments of the present invention.
Figure 11B:
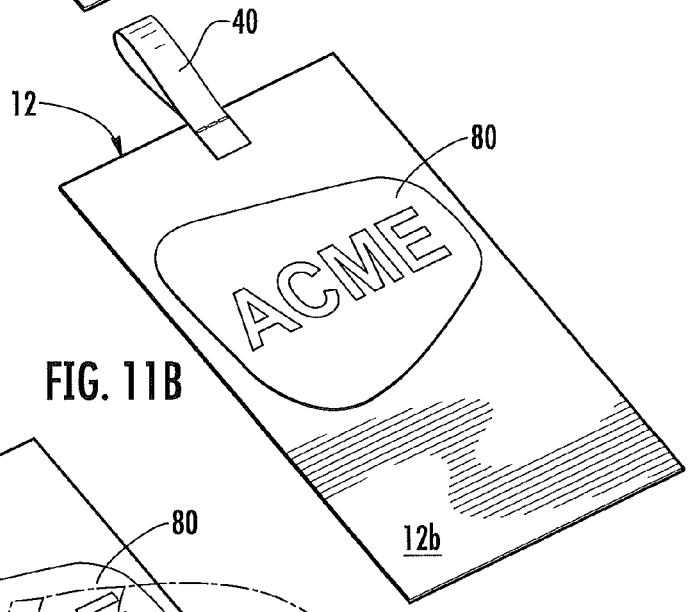
Figure 11C:
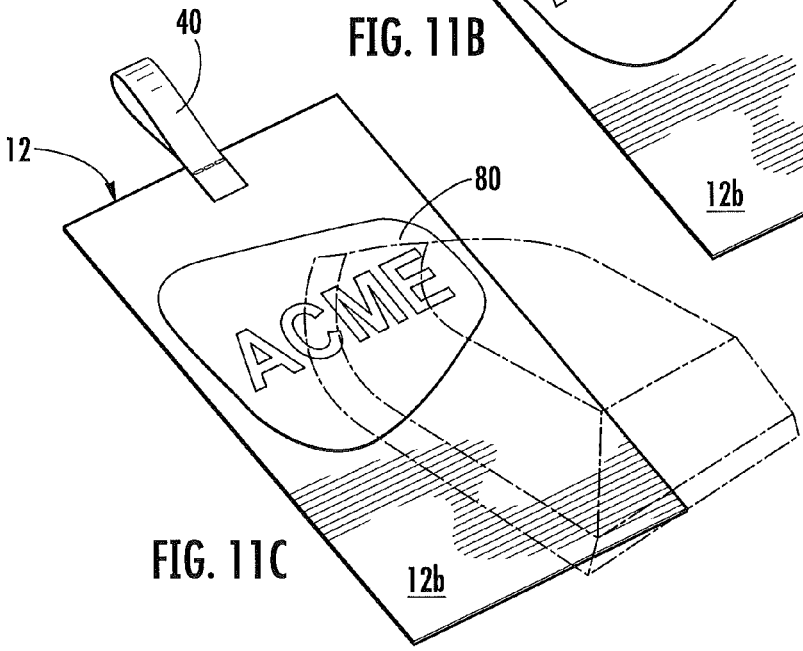

Referring to FIGS. 11A-11C, a patch 80 may be adhesively secured to the substrate second surface 12*b*. The patch 80 may include various promotional and/or other indicia, and the patch 80 may have various shapes and configurations. In some embodiments of the present invention, a patch 80 may be adhesively secured to the substrate second surface 12*b* without requiring additional pressure or heat. In other embodiments of the present invention, a patch 80 may be an "iron-on" patch and is adhesively secured to the substrate second surface 12*b* with the application of pressure or heat, as illustrated in FIG. 11C.

Figure 12A:
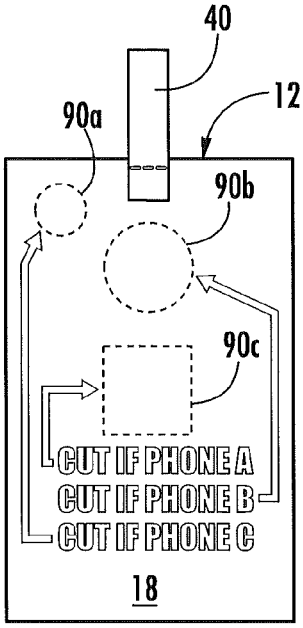
FIGS. 12A-12C are perspective views of the substrate of the apparatus of FIG. 1 illustrating patterns formed on the removable protective layer of material, according to some embodiments of the present invention.
Figure 12B:
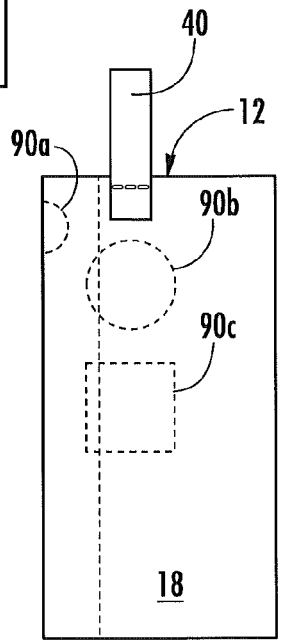
Figure 12C:
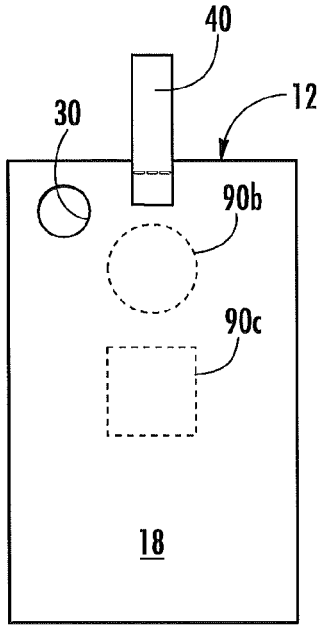

In some embodiments of the present invention, the removable, protective layer of material 18 may include one or more patterns that facilitate forming cutouts in the substrate 12, as illustrated in FIGS. 12A-12C. In the illustrated embodiment of FIG. 12A, three cutout patterns 90*a*, 90*b*, and 90*c* are printed or otherwise formed on the protective layer of material 18. Each pattern 90*a*, 90*b*, 90*c* corresponds to a camera lens or other element of a respective different electronic device. For example, pattern 90*a* corresponds to a camera lens for cell phone A, pattern 90*b* corresponds to a camera lens for cell phone B, and pattern 90*c* corresponds to a camera lens for cell phone C. A user folds the substrate 12 along the middle of each cutout pattern to facilitate cutting an aperture in the substrate 12. In the illustrated embodiment, a user has folded the substrate 12 in FIG. 12B to facilitate cutting an aperture in the substrate 12 using pattern 90*a*. The resulting aperture 30 is illustrated in FIG. 12C. Embodiments of the present invention are not limited to patterns being formed only on the protective layer of material 18. In other embodiments, patterns may be printed or otherwise formed on the substrate first surface 12*a*. Moreover, embodiments of the present invention are not limited to the illustrated patterns. Patterns of various shapes and sizes may be utilized.

Figure 6:
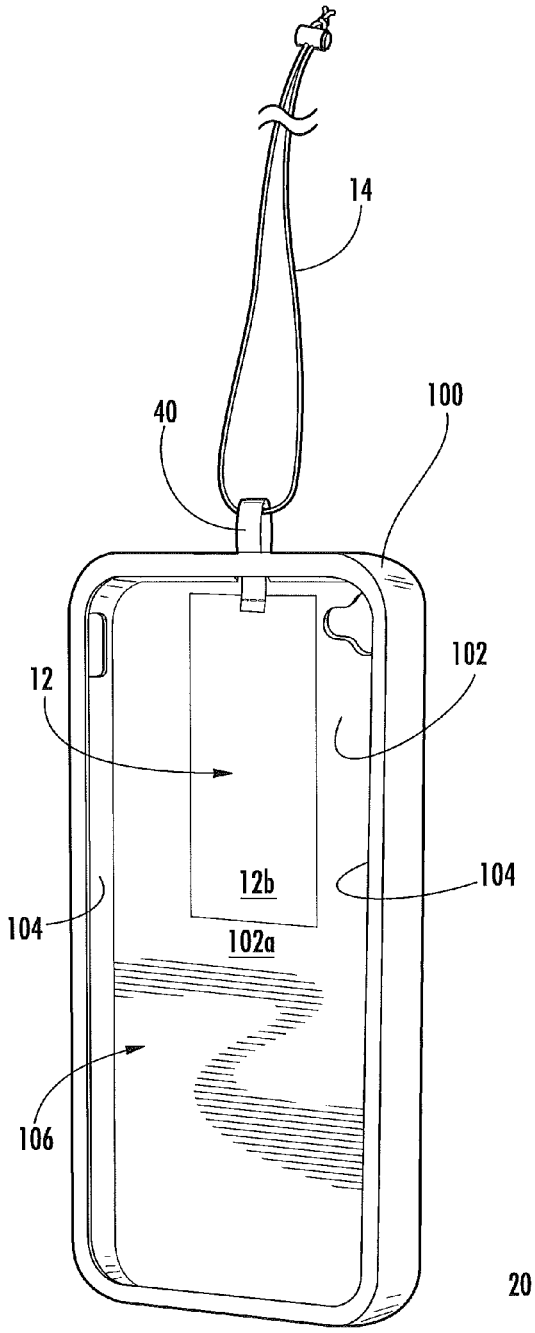
FIG. 6 is a perspective view of an exemplary protective case for a hand held electronic device that includes an apparatus for carrying the hand held electronic device, according to some embodiments of the present invention.
Figure 7:
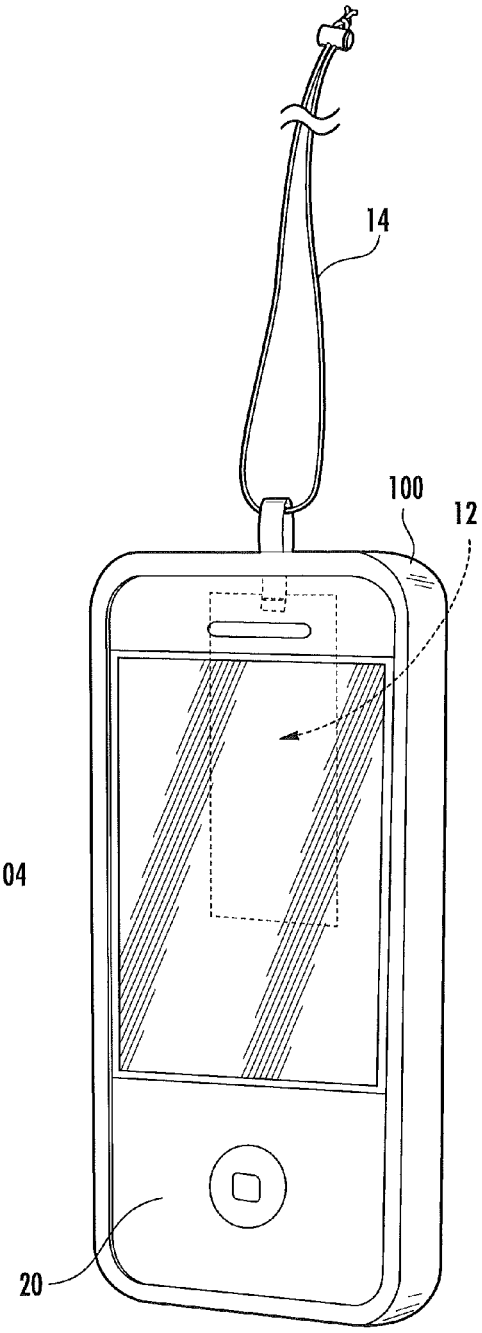
FIG. 7 is a perspective view of a hand held electronic device with the protective case of FIG. 6 secured thereto, according to some embodiments of the present invention.

Referring now to FIGS. 6 and 7, a protective case 100 for a hand held electronic device 20, according to some embodiments of the present invention, is illustrated. The illustrated protective case 100 includes a base wall 102 and a raised peripheral wall 104 extending outwardly from the base wall 102 that defines a cavity 106 for receiving an electronic device 20 therein, as illustrated in FIG. 7. Typically, an electronic device 20 is snugly received within such a protective case 100. As such, when an electronic device 20 is inserted within the cavity 106, the back of the housing of the electronic device 20 typically is in face-to-face contact with the surface 102*a* of the base wall 102 or is closely adjacent to the surface 102*a* of the base wall 102. Protective cases having various shapes and/or configurations may be utilized with embodiments of the present invention. The present invention is not limited to the illustrated case 100.

In the illustrated embodiment, the protective case 100 also includes a flexible substrate 12 and a lanyard 14 secured to the substrate 12, as described above, that allows the protective case 100 and an attached electronic device 20 to be suspended around the neck of a user. The substrate 12 is adhesively secured to the base wall surface 102*a* as described above. The adhesive material 16 utilized is intended to securely attach the substrate 12 to the base surface 102*a* such that removal therefrom is difficult. For example, in some embodiments of the present invention, the adhesive material is capable of withstanding 1,000 grams of shear at 72° F. in accordance with ASTM D3654.

The substrate 12 may have various shapes and configurations to accommodate the shape and/or functionality of a protective case 100. Also, the illustrated substrate 12 includes an attachment loop 40 extending from the substrate first end portion 12C, and the lanyard is secured to the substrate first end portion via the attachment loop. As described above, the attachment loop 40 is a strap of flexible material sewn to the substrate 12 via thread 42. Exemplary thread 42 may include, but is not limited to, a heat-resistant aramid or similar fiber 42. In some embodiments, the strap of flexible material and the substrate are formed of the same or similar fabric, such as, for example, rip-stop nylon, rip-stop polyester, silk etc. In the illustrated embodiments, the lanyard 14 is secured directly to the attachment loop 40. However, in other embodiments of the present invention, the lanyard 14 may be secured to the attachment loop 40 via a coupler, as described above.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An apparatus, comprising:

a flexible substrate having opposite first and second surfaces and opposite first and second end portions, wherein a layer of adhesive material is applied to at least a portion of the substrate first surface;

a protective layer of material releasably secured to the adhesive material which, when removed, exposes the adhesive material and allows the substrate to be secured to a housing of a hand held electronic device via the adhesive material; and a lanyard for suspending the substrate and an attached electronic device around the neck of a user, wherein the lanyard is secured to the substrate and wherein the protective layer includes one or more patterns to facilitate forming cutouts in the substrate and securing the substrate to the housing of the hand held electronic device.

2. The apparatus of claim 1, wherein the substrate comprises a flexible fabric.

3. The apparatus of claim 2, wherein the flexible fabric comprises rip-stop nylon, rip-stop polyester, or silk.

4. The apparatus of claim 2, wherein the flexible fabric has a thickness of less than about 0.015 inches.

5. The apparatus of claim 1, wherein the substrate has a polygonal, round, oval, or hourglass shape.

6. The apparatus of claim 1, wherein the substrate has an elongated rectangular shape.

7. The apparatus of claim 1, wherein the lanyard is secured to the substrate first end portion.

8. The apparatus of claim 1, wherein the substrate first end portion includes an attachment loop extending therefrom, and wherein the lanyard is secured to the attachment loop.

9. The apparatus of claim 8, wherein the lanyard is secured to the attachment loop via a coupler.

10. The apparatus of claim 8, wherein the attachment loop comprises a strap of flexible material sewn to the substrate.

11. The apparatus of claim 10, wherein the strap of flexible material comprises rip-stop nylon, rip-stop polyester, or silk, and wherein the strap is sewn to the substrate using a heat-resistant aramid fiber.

12. The apparatus of claim 1, wherein the substrate comprises an aperture formed therein through which a camera lens in the housing of an electronic device is exposed when the substrate is secured to the housing.

13. The apparatus of claim 1, wherein the substrate second surface has a tactile configuration that facilitates gripping by a user's hand.

14. The apparatus of claim 13, wherein the tactile configuration comprises an array of raised portions extending outwardly from the substrate second surface.

15. The apparatus of claim 1, wherein the substrate second surface comprises indicia.

16. The apparatus of claim 1, wherein the substrate second surface has a blank space area thereon for receiving indicia.

17. The apparatus of claim 1, wherein the layer of adhesive material comprises an adhesive tape.

18. The apparatus of claim 1, further comprising a patch adhesively secured to the substrate second surface, wherein the patch comprises indicia.

19. The apparatus of claim 1, wherein the protective layer of material comprises at least one pattern thereon for facilitating cutting an aperture in the flexible substrate by a user.

20. An apparatus, comprising:

a substrate having opposite first and second surfaces and opposite first and second end portions, wherein the substrate first end portion includes an attachment loop extending therefrom, and wherein a layer of adhesive material is applied to at least a portion of the substrate first surface;

a protective layer of material releasably secured to the adhesive material which, when removed, exposes the adhesive material and allows the substrate to be secured to a housing of a hand held electronic device via the adhesive material; and a lanyard for suspending the substrate and an attached electronic device around the neck of a user, wherein the lanyard is secured to the attachment loop and wherein the protective layer includes one or more patterns to facilitate forming cutouts in the substrate and securing the substrate to the housing of the hand held electronic device.

21. The apparatus of claim 20, wherein the substrate comprises rip-stop nylon, rip-stop polyester, or silk.

22. The apparatus of claim 20, wherein the attachment loop comprises a strap of flexible material sewn to the substrate.

23. The apparatus of claim 22, wherein the strap comprises a fabric and wherein the strap is sewn to the substrate using a heat-resistant aramid fiber.

24. The apparatus of claim 20, wherein the substrate comprises an aperture formed therein through which a camera lens in the housing of an electronic device is exposed when the substrate is secured to the housing.

25. The apparatus of claim 20, wherein the substrate second surface has a tactile configuration comprising an array of raised portions extending outwardly from the substrate second surface that facilitates gripping by a user's hand.

26. The apparatus of claim 20, wherein the substrate second surface comprises indicia.

27. The apparatus of claim 20, wherein the substrate second surface has a blank space area thereon for receiving indicia.

28. The apparatus of claim 20, wherein the protective layer of material comprises at least one pattern thereon for facilitating cutting an aperture in the flexible substrate by a user.

* * * * *